US011111781B2

(12) United States Patent
Tubel

(10) Patent No.: US 11,111,781 B2
(45) Date of Patent: Sep. 7, 2021

(54) INSTRUMENTING UNCONVENTIONAL WELLS FOR REAL TIME IN SITU FRAC HEIGHT DETERMINATION, RESERVOIR FLUID MOVEMENT, PRODUCTION MONITORING AND WELL INTEGRITY IN FRACTURED STAGES

(71) Applicant: Tubel LLC, The Woodlands, TX (US)

(72) Inventor: Paulo Tubel, The Woodlands, TX (US)

(73) Assignee: Tubel LLC, The Woodlands, TX (US)

( * ) Notice: Subject to any disclaimer, the term of this patent is extended or adjusted under 35 U.S.C. 154(b) by 8 days.

(21) Appl. No.: 16/794,418

(22) Filed: Feb. 19, 2020

(65) Prior Publication Data

US 2020/0263536 A1 Aug. 20, 2020

Related U.S. Application Data

(60) Provisional application No. 62/807,822, filed on Feb. 20, 2019.

(51) Int. Cl.

| | |
|---|---|
| ***E21B 43/26*** | (2006.01) |
| ***E21B 47/01*** | (2012.01) |
| ***E21B 47/12*** | (2012.01) |
| ***E21B 49/00*** | (2006.01) |
| ***E21B 47/06*** | (2012.01) |
| ***E21B 47/04*** | (2012.01) |

(52) U.S. Cl.

CPC ..... *E21B 47/12* (2013.01); *E21B 43/26* (2013.01); *E21B 47/04* (2013.01); *E21B 47/06* (2013.01)

(58) Field of Classification Search

CPC ..... E21B 43/26; E21B 49/00; E21B 49/006; E21B 47/01; E21B 47/12

See application file for complete search history.

(56) References Cited

U.S. PATENT DOCUMENTS

| | | | | |
|---|---|---|---|---|
| 5,318,123 | A * | 6/1994 | Venditto | E21B 43/26 166/250.1 |
| 2007/0215345 | A1* | 9/2007 | Lafferty | E21B 43/26 166/250.1 |
| 2015/0322760 | A1* | 11/2015 | Badri | E21B 47/06 166/308.1 |
| 2021/0025267 | A1* | 1/2021 | Christie | E21B 43/26 |

* cited by examiner

*Primary Examiner* — Kenneth L Thompson
(74) *Attorney, Agent, or Firm* — Maze IP Law, P.C.

(57) ABSTRACT

A system for deploying sensors throughout a vertical section and a horizontal section of an unconventional well comprises a mandrel comprising a set of extendable arms; a conductivity sensor mounted on a first predetermined subset of the set of movable arms; a strain sensor mounted on a second predetermined subset of the set of movable arms; a first downhole tool configured to be placed in the horizontal section of the unconventional well; a second downhole tool placed in a vertical section of the well, the first downhole tool and the second downhole tool adapted to operate simultaneously; a navigation package; a real time communications short hop data communicator; a data communicator; a downhole power source; and a surface system configured to collect and process data obtained in the well. The system can be used to provide data to evaluate conditions in the well and its reservoirs as well as frac height and frac width.

20 Claims, 2 Drawing Sheets

INSTRUMENTING UNCONVENTIONAL WELLS FOR REAL TIME IN SITU FRAC HEIGHT DETERMINATION, RESERVOIR FLUID MOVEMENT, PRODUCTION MONITORING AND WELL INTEGRITY IN FRACTURED STAGES

RELATION TO OTHER APPLICATIONS

This application claims priority through U.S. Provisional Application 62/807,822 filed on Feb. 20, 2019.

BACKGROUND

Better understanding of the effectiveness of frac techniques such as plug and perf as well as sleeves and balls will require that sensors be deployed in the wells for monitoring of the geological formations, fluid flow into the wellbore and frac effectiveness. The blind use of existing techniques basically increases the length of the horizontal section of the well and the number of clusters per stage to increase production and is not a sustainable model for future exploration of unconventional resources due to the techniques' inefficiencies and high cost.

The industry at this time has very limited knowledge on how to design a better fracture process. The number of clusters on a plug and perf fracture technique, the distance among the clusters, the number of stages or the length of the horizontal well are determined by trial and error and in most cases rely on "what has been done in the past" as the basis for the work going forward. The industry has also long relied on multiple theories and beliefs regarding hydraulic fracture and production in unconventional wells.

However, the use of surface measurements and simulations to determine downhole parameters is at best flawed and inaccurate. The limitations of downhole in situ sensor measurements prevent the accurate determination of obtaining information in real time related to the frac height of the fracs being performed in the well, obtaining information on the movement of fluids in in the reservoir and particular monitor the movement of water in the reservoir to understand the production requirements to slow the water breakthrough into the production stream, determining the type of fluid being produced, obtaining information on the amount of fluid being produced from each stage of the horizontal section of the well, evaluating casing compaction and strain due to excessive shock from perforating guns or from formation compaction, using information to monitor adjacent wells for frac, re-frac and field interference evaluation, or the like.

The use of gauges and cables installed on the outside of the casing has allowed for a limited amount of information to be obtained from downhole to evaluate hydraulic fractures while predictions of hydraulic fracture growth from physical models have been enhanced by rigorous matching of observed net fracturing pressure and multiple sensors deployment in observation wells. However, as fracture treatment design optimization will always require the use of physical models, care must be taken whenever possible to "calibrate" fracture models to actual measured fracture growth. The problem is that it simply has not been possible to gather direct data on in-situ hydraulic fracture dimension growth in typical field settings. Utilizing multiple measurements of hydraulic fracture growth in a given area does allow reasonable model calibration and enhance the hydraulic fracture stimulation practices.

The industry also uses tiltmeters and microseismic monitoring to obtain data during the fracture process. These methods do not provide very accurate measurements of the deformation of the formations. Surface tiltmeters are limited on its accuracy and well inclination The use of downhole cable-based pressure and temperature sensors mounted on the outside of the casing has provided some useful but limited information. The limitation on the number of gauges that can be deployed also reduces the usefulness of the technology. There is also the risk of perforating the cable external to the casing that connects the gauge to the surface providing power and communications making the downhole gauges inoperative. The excessive time required to deploy a cable-based gauge in the well is also another limitation to the ability to collect data downhole. Also, the size of the gauge may require a larger borehole to be drilled.

Another technology that is being used in limited quantities is the deployment of a cable downhole outside the casing where a fiber optic string is used instead of an electrical cable. The fiber optic can be used to determine distributed temperature and distributed strain (sound) downhole with the average resolution of about 1 meter per data point along the entire length of the fiber. The same restrictions and limitations for electrical cable deployment described above apply for fiber optic-based cables. Additional precautions are necessary due to the fragility of the fiber and potential failure due to the high shock generated by the perforating guns in the well during the frac process. The fiber cable is very difficult to repair if it fails at the surface or in the wellbore. The two sections of the fiber that were broken have to be aligned precisely and fused in place.

Another technique widely used is the deployment of pressure gauges at the surface wellhead which produce data that are processed using existing software packages that attempt to compensate the data for friction and other downhole parameters. In general, the same techniques are used to compensate for vertical and horizontal wells but these modeling techniques are not accurate to be used for frac and reservoir evaluations.

FIGURES

Various figures are included herein which illustrate aspects of embodiments of the disclosed inventions.

DESCRIPTION OF EXEMPLARY EMBODIMENTS

Figure 1:
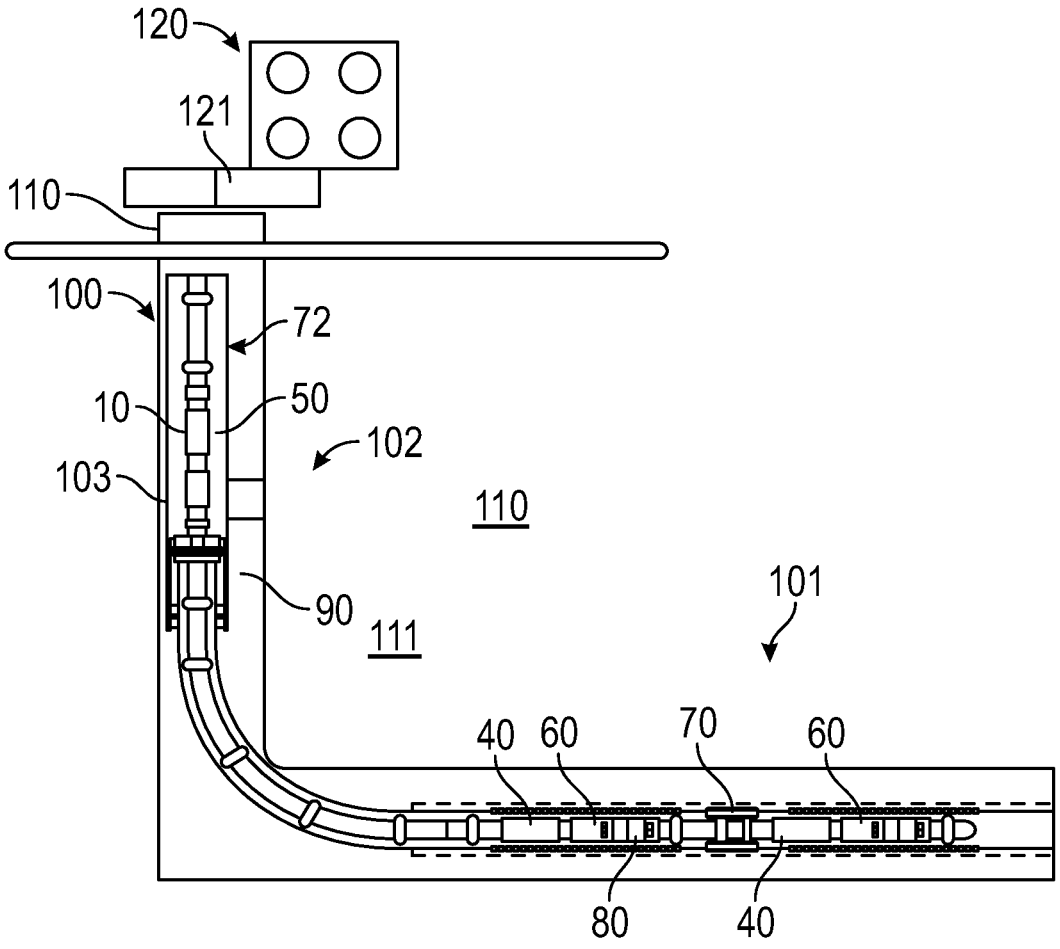
FIG. 1 is a schematic view of a proposed system deployed in a well.
Figure 2:
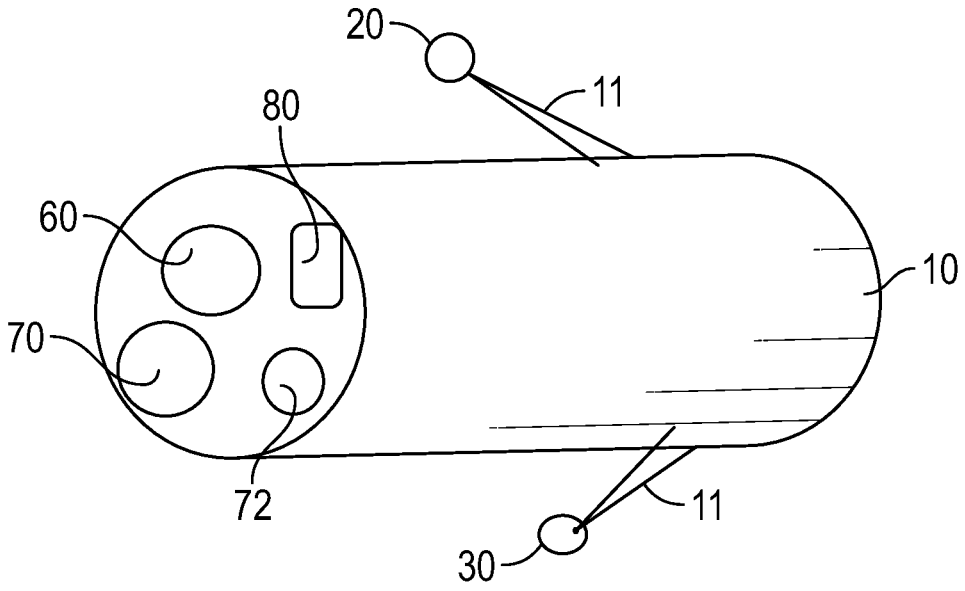
FIG. 2 is a view in partial perspective illustrating a mandrel with extendable arms and sensors.

In a first embodiment, referring generally to FIGS. 1 and 2, system 1 for deploying sensors throughout vertical section 102 and horizontal section 101 of an unconventional well, e.g. well 100, comprises a plurality of tools 40,50 (which may be considered to be or otherwise referred to as a gauge). As described below, downhole tools 40,50 comprises mandrel 10, which defines a housing, and various sensors as described below including strain sensors (adapted to come into physical contact with reservoir wall to detect wall deformation), pressure sensors (which can be disposed inside and/or outside of tools 40,50), and flow/fluid sensors.

Referring additionally to FIG. 2, each tool 40,50 is substantially identical, comprising mandrel 10, which may be a high shock resistance mandrel, configured to be disposed downhole, where mandrel 10 defines a housing and comprises a set of extendable arms 11; one or more sensors 20 mounted on a first predetermined subset of the set of extendable arms 11, at least one sensor 20 comprising a conductivity sensor configured to collect resistivity data from reservoir 110, which is accessible via unconventional well 100 and which is being frac'ed, when extendable arm 11 to which sensor 20 is mounted extends to place sensor 20 into physical contact with reservoir 111; one or more strain sensors 30 mounted on a second predetermined subset of the set of extendable arms 11, at least one strain sensor 30 operative to measure frac height and/or width; navigation package 60 typically disposed at least partially within mandrel 10 and adapted to determine the location of strain sensors 30 in well 100; one or more real time communications short hop data communicators 70 typically disposed at least partially within mandrel 10; one or more data communicators 72 typically disposed at least partially within mandrel 10 and operatively in communication with conductivity sensors 20, strain sensors 30, navigation package 60, and real time communications short hop data communicator 70; one or more downhole power sources 80 typically disposed at least partially within mandrel 10 and operatively in communication short hop data communicator 70 and data communicator 72; and surface system 120 configured to collect and process data obtained in well 100.

One or more first downhole tools 40 may be placed in horizontal section 101 of unconventional well 100 and are operative to acquire data downhole related to predetermined condition characteristics downhole. One or more second downhole tools 50 may be placed in vertical section 102 of well 100 that will be populated with strain sensors 30 to monitor deformation of the formations during the fractures to determine the height of the frac. First downhole tool 40 and second downhole tool 50 are typically adapted to operate substantially simultaneously and to acquire data downhole related to predetermined condition characteristics downhole. In embodiments, a plurality of downhole tools 40,50 are deployed downhole in various sections of well 100 and positioned at multiple locations in vertical section 102 and horizontal section 101 of well 100.

In most embodiments, sensor 20 comprises a sensor adapted to withstand shock generated by perforating guns. In addition to comprising a conductivity sensor, sensor 20 may further comprise a resistivity sensor which is adapted to collect resistivity data from reservoirs 110,111 that are being frac'ed and for monitoring fluid movement during production; an induction and lateral measurement sensor; an electrical current sensor adapted for fluid identification; a differential pressure sensor adapted for fluid flow measurements; a fracture diagnostic sensor for direct measurement of fracture dimensions and orientation; a produced fluid identification sensor deployed as part of casing strain pup joint 90, the produced fluid identification sensor adapted to verify the amount of oil and water being produced; a flowmeter adapted to provide information from each stage in horizontal section 101 of well 100; an electrode mounted inside a pipe deployed in the well; or the like; or a combination thereof. If present, the fluid identification sensor typically comprises an oil sensor and a water content sensor.

In most embodiments, strain sensors 30 comprise a strain sensor adapted to evaluate frac height such as in vertical section 102; a strain sensor adapted to monitor casing health; a strain sensor adapted to monitor casing integrity and obtain frac information, the strain sensor mounted on an internal wall of the downhole tool and operatively in communication with an electronics data collection module; or the like; or a combination thereof. In certain embodiments, strain sensors 30 comprise a strain sensor adapted to monitor frac status in a formation placed outside the strain sensor 30 in multiple directions around well 100.

In embodiments, navigation package 60 comprises one or more accelerometers adapted to aid in determination of a position of strain sensors 30 in well 100, typically by allowing a determination of a location of extendable arms 11 in a perpendicular axis of well 100 in relation to a zero rotation point determined by the accelerometers assembled in an X, Y, and Z axis set.

In various embodiments. data communicator 72 comprises a fluid pulse generator adapted to provide downhole to surface communications by creating pulses in the fluid that are indicative of data. In these embodiments, system 1 typically further comprises fluid pulse detector 121 located proximate a surface of the well, where fluid pulse detector 121 is operative to convert pressure changes into electrical pulses.

Typically, downhole power source 80 is configured to provide in situ downhole power generation and comprises an impeller operatively connected to an electrical generator. Power source 80 may further comprise batteries.

In most embodiments, extendable arms 11 of one or more first downhole tools 40 and second downhole tools 50 may be further operative to move a piston (not shown in the figures) and/or spring (not shown in the figures) that will extend to physically contact reservoir 110,111 to allow direct measurements from the formations perpendicular to the set of arms such as strain and other measurements.

Figure 3:
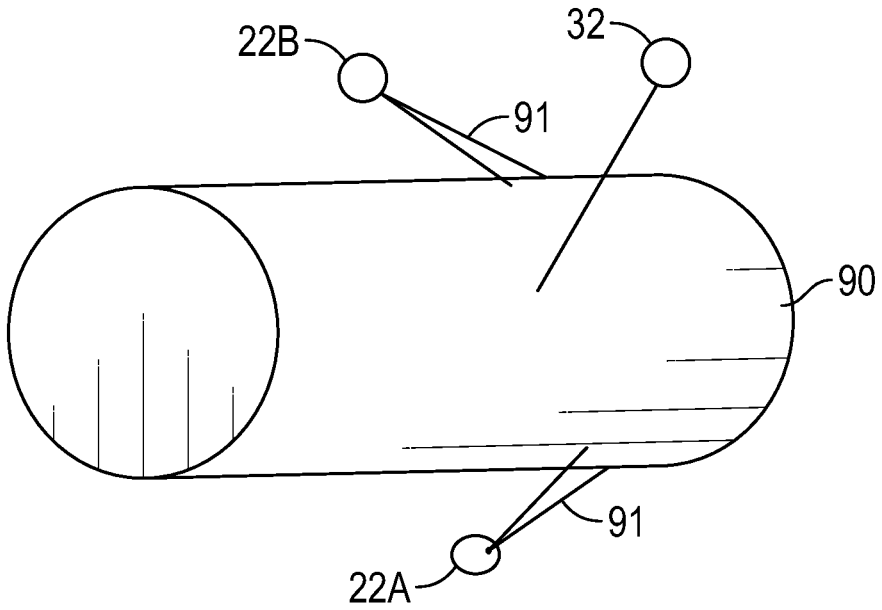
FIG. 3 is a view in partial perspective illustrating a casing strain pup joint with extendable arms and sensors.

In certain embodiments, referring additionally to FIG. 3, system 1 further comprises one or more casing strain pup joints 90, at least one comprising a set of selectively extendable arms 91, where downhole pup joint 90 is deployable as part of casing string 103 (FIG. 1) and which may be useful for in situ measurements. In these embodiments, sensors 22, comprising first sensor 22A, are mounted onto a predetermined subset of extendable arms 91, and the predetermined subset of extendable arms 91 are configured to allow sensor 22A to physically contact reservoir 110,111 (FIG. 1). In these embodiments, sensors 22 may also comprising second sensor 22B as part of at least one casing strain pup joint 90 where second sensor 22B is cemented in well 100 (FIG. 1) once positioned to a desired position in well 100. In these embodiments, sensors 22 mounted may further comprise a set of sensors deployed within each frac stage and usable to identify an optimal placement of fracturing stages. Sensor 22 may further comprise a set of strain sensors 32 deployed within vertical section 102 of well 100. Sensors 22 are typically of a type useful to help improve optimization of a stimulation treatment design being determining more accurately the frac height.

In any of these embodiments, as illustrated in FIG. 1, sensors 20, 22, and/or 30 and associated electronics, power source 80, and other hardware of first downhole tool 40 and of second downhole tool 50 may be mounted on an outside of mandrel 10 of tools 40,50 in a manner that allows a workover tool to pass unobstructed over or around first downhole tool 40 and second downhole tool 50.

In the operation of exemplary methods, referring back to FIG. 1, a plurality of downhole tools 40,50 with their associated sensors 20,22,30 may be deployed throughout vertical section 102 and horizontal section 101 of unconventional well 100 as part of system 1 that can be deployed in reservoir 110,111 of well 100 as part of casing string 103 to provide information directly from well 100 that is being frac'ed and used to provide data from within the stages of horizontal section 101 of well 100 for a predetermined set of well related evaluations such as for frac evaluation related to width and depth of the frac opening in the formation fluid identification, flow measurements, and resistivity/induction from the producing reservoirs to monitor for fluid movement to slow the flow of water into the production stream. System 1 may be deployed and used without requiring a change to pre-existing procedures to frac, clean, and/or produce well 100.

In embodiments, system 1 is deployed in well 100, which comprises horizontal section 101 and vertical section 102, typically by deploying first downhole tool 40 in horizontal section 101 and second downhole tool 50 in vertical section 102. Typically, power is provided to downhole tools 40,50 and their associated components via one or more downhole power sources 80, typically each downhole power source 80 providing power to its associated downhole tool 40,50 as described above.

Sensors 20 are deployed in vertical section 102 and horizontal section 101 of well 100 and enabled to obtain a predetermined set of well data. Placement typically comprises extending one or more extendable arms 11 to which sensor 20 is mounted to place sensor 20 into physical contact with reservoir 111. Strain sensors 30 may also be extended via extendable arm 11 to which sensor 30 is mounted to place sensor 30 into physical contact with reservoir 111. Sensor 20 and sensor 30 may be mounted to the same or to different extendable arms 11.

As noted above, at least one sensor 20 of sensors 20 may be permanently deployed in well 100. In addition, in embodiments where first downhole tool 40 and/or second downhole tool 50 comprise a strain sensor, a directional sensor, a pressure sensor, a temperature sensor, or a formation sensor, data from the strain sensor and the directional sensor may be used to determine a direction, width, and distance of travel of the frac into a geological formation.

Data obtained by sensors 20,22,30 are communicated to surface system 120 using short hop data communicators 70 and data communicators 72. Surface system 120 gathers and processes the communicated well data from downhole to perform a predetermined data analysis. Typically, data communications links are established between downhole tools 40,50 via real time communications short hop data communicators 70 which are in communication with their associated data communicators 72 which, in turn, are in communication with their associated 20,22,30 and navigation package 60. In turn, data are then communicated through well 100 to surface system 120 configured to collect and process data obtained in well 100 such as via a fluid pulse generator adapted to provide downhole to surface communications as described above.

Well data are provided in real time and may be used to supply a predetermined set of measurements from inside well 100. Typically, these measurements may be obtained before a frac operation, during a frac operation, during flowback, and/or throughout the hydrocarbon producing life of the well. By way of example and not limitation, data from strain sensors 30 may comprise data useful to help determine if a deformation of casing string 103 occurred such as during perforation, frac, compression of the formations or other events.

Well data typically comprise real time data related to the frac height being created in multiple stages in the well; data related to movement of fluids in reservoir 110,111 and particular monitor the movement of water in reservoir 110,111 to understand production requirements to slow water breakthrough into a production stream; fluid type data related to fluid in the well being oil, water or gas; fluid production data related to an amount of fluid being produced from each stage of the horizontal section of the well; data related to evaluation of casing compaction and strain due to excessive shock from perforating guns or from formation compaction; data useful to monitor an adjacent well for frac, re-frac and field interference evaluation; data sufficient to determine an optimum number of clusters within each frac stage and how many frac stages to create downhole; and the like; or a combination thereof.

As used herein the predetermined data analysis may comprise one or more of using data from the system to evaluate frac characteristics; using data from the system to evaluate casing integrity; using data from the system to evaluate flow patterns downhole; using data from the system to characterize a hydraulic frac growth processes in reservoir 110,111; using data from the system to analyze effectiveness of the frac treatment by mapping where frac fractures are growing. This analysis may allow an operator to have a better understanding of the frac process effectiveness and how to increase overall production.

Data from the system are typically used to identify producing areas within multiple frac stages and/or to monitor movement of water in reservoir 110,111 sufficient to determine production requirements to slow water breakthrough into a production stream. In addition, data may be used to help determine if the type of fluid being produced is oil, water or gas; to determine an amount of fluid being produced from each stage of the horizontal section of the well; to evaluate casing compaction and strain due to excessive shock from perforating guns or from formation compaction; to monitor an adjacent well for frac, re-frac and field interference evaluation; to determine an optimum number of clusters within each frac stage and how many frac stages to create downhole; to calculate parameters needed to obtain a higher level of optimization of hydrocarbon production by delaying, controlling and shutting in the flow of water into the wellbore and evaluate the effectiveness of re-frac operations; or the like; or a combination thereof.

As will be understood by one of ordinary skill in the downhole drilling art, system 1 can be deployed in wells as part of casing string 103 to provide desired information directly from the well that is being frac'ed, provide data from within the stages of the horizontal section of the well for fluid identification, flow measurements, and resistivity/induction from the producing reservoirs 110,111 to monitor for fluid movement to slow the flow of water into the production stream. The ability to monitor casing strain and formation compaction will also extend the life of the wells. The permanent deployment of these sensors in wells will also provide time as a fourth dimension in measurements for the evaluation of frac's and production for the lifecycle of the well. The claimed method has the potential to significantly improve ultimate recovery from unconventional oil and gas resources and decrease the per well cost and reduce long term maintenance costs of producing hydrocarbons. The system will analyze the effectiveness of the frac treatment by mapping where the fractures are growing so operators can have a better understanding of the frac process effectiveness and how to increase overall production.

Once deployed, cement may be pumped behind extendable arms 11 to fix extendable arms 11 against formations.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A method of deploying sensors throughout a set of vertical and horizontal sections of unconventional wells as part of a system to be deployed in a well deployed in a reservoir as part of the casing string to provide information directly from the well that is being fractured including data from within stages of the horizontal section of the well for a predetermined set of well related evaluations, the system comprising a plurality of downhole tools configured to be placed in the horizontal sections and vertical sections of the unconventional well where each downhole tool is operative to acquire data downhole related to a predetermined condition characteristic downhole and each downhole tool comprises a mandrel adapted to be disposed downhole, the mandrel defining a housing and comprising a set of extendable arms; a first sensor mounted on a first predetermined subset of the set of extendable arms; a second sensor mounted on a second predetermined subset of the set of extendable arms, the second sensor comprising a strain sensor; a navigation package configured to determine a location of the strain sensor in the well; a real time communications short hop data communicator; a data communicator operatively in communication with the first sensor, the second sensor, the navigation package, and the real time communications short hop data communicator; and a downhole power source operatively in communication with the short hop data communicator and the data communicator; the system further comprising a surface system configured to collect and process data obtained in the well; the method comprising:

a) deploying a first downhole tool in the horizontal section;
b) deploying a second downhole tool in the vertical section;
c) extending a predetermined set of the extendable arms to place a predetermined set of sensors into physical contact with a reservoir associated with the well;
d) enabling the sensors in the vertical and horizontal sections of the well to obtain a predetermined set of well data;
e) communicating the well data from the first downhole tool and the second downhole tool to the surface system;
f) collecting the communicated well data at the surface system; and
g) using the surface system to process the collected well data from downhole to perform a predetermined data analysis.

2. The method of deploying sensors throughout vertical and horizontal sections of unconventional wells of claim 1, wherein the well data comprise:

a) real time data related to a height of the fracture being created in multiple stages in the well;
b) data related to movement of fluids in the reservoir and, in particular, monitor movement of water in the reservoir to understand production requirements to slow water breakthrough into a production stream;
c) fluid type data related to fluid in the well, or fluid identification of fluid in the well as, oil, water or gas;
d) fluid production data related to an amount of fluid being produced from each stage of the horizontal section of the well;
e) data related to evaluation of casing compaction and strain due to excessive shock from perforating guns or from formation compaction;
f) data useful to monitor an adjacent well for frac, re-frac and field interference evaluation;
g) data useful for frac evaluation related to width and depth of a frac opening in the formation, flow measurements, and resistivity/induction from producing reservoirs to monitor for fluid movement to slow the flow of water into the production stream; or
h) data sufficient to determine an optimum number of clusters within each frac stage and how many frac stages to create downhole.

3. The method of deploying sensors throughout vertical and horizontal sections of unconventional wells of claim 1, wherein the predetermined data analysis comprises:

a) using data from the system to evaluate frac characteristics;
b) using data from the system to evaluate casing integrity;
c) using data from the system to evaluate flow patterns downhole;
d) using data from the system to characterize a hydraulic frac growth processes in the reservoir;
e) using data from the system to analyze effectiveness of frac treatment by mapping where frac fractures are growing;
f) using data from the system to identify producing areas within multiple frac stages;
g) using the data to monitor movement of water in the reservoir sufficient to determine production requirements to slow water breakthrough into a production stream;
h) using the data to determine if the fluid being produced is oil, water or gas;
i) using the data to determine an amount of fluid being produced from each stage of the horizontal section of the well;
j) using the data to evaluate casing compaction and strain due to excessive shock from perforating guns or from formation compaction due to production of hydrocarbons;
k) using the data to monitor and evaluate an adjacent well for frac, re-frac and field interference evaluation;
l) using the data to determine an optimum number of clusters within each frac stage and how many frac stages to create downhole; or
m) using data from the system to calculate parameters needed to obtain a higher level of optimization of hydrocarbon production by delaying, controlling and shutting in the flow of water into the wellbore and evaluate the effectiveness of re-frac operations.

4. The method of deploying sensors throughout vertical and horizontal sections of unconventional wells of claim 1, wherein the well data are provided in real time to supply a predetermined set of measurements from inside the well in real time.

5. The method of deploying sensors throughout vertical and horizontal sections of unconventional wells of claim 1, wherein the collected data comprise data useful to help determine if a deformation of a casing occurred.

6. The method of deploying sensors throughout vertical and horizontal sections of unconventional wells of claim 1, wherein the system is deployed and used without requiring a change to pre-existing procedures to frac the well, clean the well, or produce the well.

7. The method of deploying sensors throughout vertical and horizontal sections of unconventional wells of claim 1, wherein:

a) the first sensor of the first downhole tool or the second sensor of the second downhole tool comprises a strain sensor;

b) the first sensor of the first downhole tool or the second sensor of the second downhole tool comprises a directional sensor; and c) the method further comprises using data from the strain sensor and the directional sensor to determine a direction, width, and distance of travel of the frac into a geological formation.

8. The method of deploying sensors throughout vertical and horizontal sections of unconventional wells of claim 1, wherein at least one sensor of the sensors is permanently deployed in the well.

9. A system for deploying sensors throughout a vertical section and a horizontal section of an unconventional well, comprising:

a) a first downhole tool configured to be placed in the horizontal section of the unconventional well, the first downhole tool operative to acquire data downhole related to a predetermined condition characteristic downhole, the first downhole tool comprising:

i) a mandrel adapted to be disposed downhole, the mandrel defining a housing and comprising a set of extendable arms;

ii) a conductivity sensor mounted on a first predetermined subset of the set of extendable arms, the conductivity sensor configured to collect resistivity data from a reservoir being frac'ed when the extendable arm to which the conductivity sensor is mounted extends to place the conductivity sensor into physical contact with a reservoir accessible via the unconventional well;

iii) a strain sensor mounted on a second predetermined subset of the set of extendable arms, the strain sensor operative to evaluate frac height;

iv) a navigation package comprising an accelerometer, the navigation package adapted to determine a location of the extendable arms in a perpendicular axis of the well in relation to a zero rotation point determined by the accelerometer assembled in an X, Y, and Z axis of the well;

v) a real time communications short hop data communicator;

vi) a data communicator operatively in communication with the conductivity sensor, the strain sensor, the navigation package, and the real time communications short hop data communicator; and vii) a downhole power source operatively in communication with the short hop data communicator and the data communicator;

b) a second downhole tool configured to be placed in the vertical section of the well, the first downhole tool and the second downhole tool adapted to operate substantially simultaneously, the second downhole tool operative to acquire data downhole related to a predetermined condition characteristic downhole, the second downhole tool comprising:

i) a mandrel adapted to be disposed downhole, the mandrel defining a housing and comprising a set of extendable arms;

ii) a set of sensors, comprising:

(1) a conductivity sensor mounted on a first predetermined subset of the set of movable extendable arms, the conductivity sensor configured to collect resistivity data from the reservoir being frac'ed when the extendable arm to which the conductivity sensor is mounted extends to place the conductivity sensor into physical contact with a reservoir accessible via the unconventional well; and (2) a strain sensor operative to monitor deformation of a well formation during a fracture operation to determine the height and width of the frac;

iii) a navigation package comprising an accelerometer, the navigation package adapted to determine a location of the extendable arms in a perpendicular axis of the well in relation to a zero rotation point determined by the accelerometer assembled in the X, Y, and Z axis of the well;

iv) a real time communications short hop data communicator;

v) a data communicator operatively in communication with the conductivity sensor, the strain sensor, the navigation package, and the real time communications short hop data communicator;

vi) a downhole power source operatively in communication with the short hop data communicator and the data communicator; and c) a surface system configured to collect and process data obtained in the well, the surface system operatively in communication with the first downhole tool and the second downhole tool.

10. The system for deploying sensors throughout vertical and horizontal sections of unconventional wells of claim 9, wherein the system comprises a plurality of first downhole tools and/or second downhole tools deployed downhole and positioned at multiple locations in the vertical section and the horizontal section of the well.

11. The system for deploying sensors throughout vertical and horizontal sections of unconventional wells of claim 9, wherein the downhole power source comprises an impeller operatively connected to an electrical generator, the downhole power source configured to provide in situ downhole power generation.

12. The system for deploying sensors throughout vertical and horizontal sections of unconventional wells of claim 9, further comprising:

a) a casing strain pup joint comprising a set of selectively extendable arms, the downhole pup joint deployable as part of a casing string; and b) a sensor system comprising a first sensor mounted onto a predetermined subset of the extendable arms, the predetermined subset of the extendable arms configured to allow the sensor to physically contact the reservoir, the sensor system comprising a second sensor as part of the casing strain pup joint and cemented in the well.

13. The system for deploying sensors throughout vertical and horizontal sections of unconventional wells of claim 12, wherein:

a) the sensor mounted onto the predetermined subset of the extendable arms comprises a set of sensors deployed within a set of frac stages and usable to identify an optimal placement of fracturing stages; and b) the sensor system comprises a set of strain sensors deployed within the vertical section of the well.

14. The system for deploying sensors throughout vertical and horizontal sections of unconventional wells of claim 9, wherein the conductivity sensor mounted onto a predetermined subset of the extendable arms comprises a resistivity sensor adapted to collect resistivity data from the reservoir being frac'ed and for monitoring fluid movement during production.

15. The system for deploying sensors throughout vertical and horizontal sections of unconventional wells of claim 9, wherein the set of sensors comprise:

a) an induction and lateral resistivity measurement sensor;

b) an electrical current sensor adapted to provide fluid identification;

c) a differential pressure sensor adapted to provide a fluid flow measurement;

d) a fracture diagnostic sensor adapted to provide measurement of a fracture dimension and orientation;

e) a produced fluid identification sensor deployed as part of the pup joint, the produced fluid identification sensor adapted to verify an amount of oil and water being produced;

f) a flowmeter adapted to provide information from each stage in the horizontal section of the well; or g) an electrode mounted inside a pipe deployed in the well.

16. The system for deploying sensors throughout vertical and horizontal sections of unconventional wells of claim 15, wherein the fluid identification sensor comprises an oil sensor and a water content sensor.

17. The system for deploying sensors throughout vertical and horizontal sections of unconventional wells of claim 9, wherein the strain sensor comprises:

a) a strain sensor adapted to evaluate frac height evaluation in the vertical well section;

b) a strain sensor adapted to monitor casing health;

c) a strain sensor adapted to monitor casing integrity and obtain frac information, the strain sensor mounted on an internal wall of a downhole tool and operatively in communication with an electronics data collection module; or d) a strain sensor adapted to monitor frac status in a formation placed outside the strain sensor in multiple directions around the wellbore.

18. The system for deploying sensors throughout vertical and horizontal sections of unconventional wells of claim 9, wherein:

a) the data communicator comprises a fluid pulse generator adapted to provide downhole to surface communications via fluid pulses; and b) the surface system comprises a fluid pulse detector located proximate a surface of the well, the fluid pulse detector operative to convert pressure changes caused by the fluid pulses into electrical pulses.

19. The system for deploying sensors throughout vertical and horizontal sections of unconventional wells of claim 9, wherein the sensors, navigation package, real time communications short hop data communicator, and data communicator are mounted on an outside of the mandrel in a manner that allows a workover tool to pass a downhole tool unobstructed.

20. The system for deploying sensors throughout vertical and horizontal sections of unconventional wells of claim 9, wherein each of the first downhole tool and the second downhole tool further comprises a set of arms that are extendable to physically contact the reservoir to allow direct measurements from the formations perpendicular to the arms.

* * * * *